US010807153B2

(12) United States Patent
Merrill et al.

(10) Patent No.: US 10,807,153 B2
(45) Date of Patent: Oct. 20, 2020

(54) METHOD OF MANUFACTURING ADVANCED FEATURES IN A CORE FOR CASTING

(71) Applicants: Siemens Aktiengesellschaft, Munich (DE); Mikro Systems, Inc., Charlottesville, VA (US)

(72) Inventors: Gary B. Merrill, Orlando, FL (US); Roy Eakins, Madison, VA (US)

(73) Assignees: SIEMENS AKTIENGESELLSCHAFT, Munich (DE); MIKRO SYSTEMS, INC., Charlottesville, VA (US)

( * ) Notice: Subject to any disclaimer, the term of this patent is extended or adjusted under 35 U.S.C. 154(b) by 231 days.

(21) Appl. No.: 16/074,922

(22) PCT Filed: Mar. 18, 2016

(86) PCT No.: PCT/US2016/023016

§ 371 (c)(1),
(2) Date: Aug. 2, 2018

(87) PCT Pub. No.: WO2017/160303

PCT Pub. Date: Sep. 21, 2017

(65) Prior Publication Data

US 2019/0030593 A1 Jan. 31, 2019

(51) Int. Cl.
*B22C 9/10* (2006.01)
*B22C 9/24* (2006.01)
(Continued)

(52) U.S. Cl.
CPC ..... *B22C 9/10* (2013.01); *B22C 9/24* (2013.01); *B22C 23/00* (2013.01); *F01D 5/187* (2013.01); *F05D 2230/21* (2013.01)

(58) Field of Classification Search
CPC ..... B22C 9/10; B22C 9/24; B22C 23/00
(Continued)

(56) References Cited

U.S. PATENT DOCUMENTS 3,142,875 A 8/1961 Lirones et al.
2009/0308564 A1* 12/2009 Bedzyk ..... B22C 9/10 164/456
(Continued)

FOREIGN PATENT DOCUMENTS

CN 2892324 Y 4/2007
CN 103691878 A 4/2014
(Continued)

OTHER PUBLICATIONS

PCT International Search Report and Written Opinion dated Jul. 28, 2016 corresponding to PCT Application No. PCT/US2016/023016 filed Mar. 18, 2016.

*Primary Examiner* — Kevin P Kerns

(57) ABSTRACT

A hard tool configuration and method of manufacturing advanced detailed trailing edge features in a core for casting. The hard tool configuration includes at least a first platform and a second platform. The hard tool configuration also includes a first end of a plurality of removable rake elements removably attached to at least one of the first platform and the second platform. The hard tool configuration also includes an internal mold geometry in a spacing in between the center facing side of the first platform and the center facing side of the second platform.

10 Claims, 3 Drawing Sheets

(51) Int. Cl.
*B22C 23/00* (2006.01)
*F01D 5/18* (2006.01)

(58) Field of Classification Search
USPC ..... 164/15, 302, 369
See application file for complete search history.

(56) References Cited

U.S. PATENT DOCUMENTS

| | | | |
|---|---|---|---|
| 2011/0132564 | A1 | 6/2011 | Merrill et al. |
| 2015/0202683 | A1 | 7/2015 | Bunker |

FOREIGN PATENT DOCUMENTS

| | | | |
|---|---|---|---|
| CN | 103894541 | A | 7/2014 |
| CN | 103978162 | A | 8/2014 |
| CN | 104302423 | A | 1/2015 |
| CN | 204892842 | U | 12/2015 |
| EP | 2316593 | A2 | 5/2011 |

* cited by examiner

METHOD OF MANUFACTURING ADVANCED FEATURES IN A CORE FOR CASTING

BACKGROUND

1. Field

The present invention relates to a method of manufacturing advanced features in a core for casting.

2. Description of the Related Art

In gas turbine engines, compressed air discharged from a compressor section and fuel introduced from a source of fuel are mixed together and burned in a combustion section, creating combustion products defining a high temperature working gas. The working gas is directed through a hot gas path in a turbine section of the engine, where the working gas expands to provide rotation of a turbine rotor. The turbine rotor may be linked to an electric generator, wherein the rotation of the turbine rotor can be used to produce electricity in the generator.

In view of high pressure ratios and high engine firing temperatures implemented in modern engines, certain components, such as airfoils, e.g., stationary vanes and rotating blades within the turbine section, must be cooled with cooling fluid, such as air discharged from a compressor in the compressor section, to prevent overheating of the components.

Effective cooling of turbine airfoils requires delivering the relatively cool air to critical regions such as along the trailing edge of a turbine blade or a stationary vane. The associated cooling apertures may, for example, extend between an upstream, relatively high pressure cavity within the airfoil and one of the exterior surfaces of the turbine blade. Blade cavities typically extend in a radial direction with respect to the rotor and stator of the machine.

Airfoils commonly include internal cooling channels which remove heat from the pressure sidewall and the suction sidewall in order to minimize thermal stresses. Achieving a high cooling efficiency based on the rate of heat transfer is a significant design consideration in order to minimize the volume of coolant air diverted from the compressor for cooling. However, the relatively narrow trailing edge portion of a gas turbine airfoil may include, for example, up to about one third of the total airfoil external surface area. The trailing edge is made relatively thin for aerodynamic efficiency. Consequently, with the trailing edge receiving heat input on two opposing wall surfaces which are relatively close to each other, a relatively high coolant flow rate is entailed to provide the requisite rate of heat transfer for maintaining mechanical integrity.

Current methods of manufacturing turbine airfoils, such as those in the power industry, include providing a core for from a casting process. The cores for casting, investment casting typically, involve filling a mold form that is slightly open to allow for excessive mold filing and elimination of entrapped bubbles during processing. This process leads to excessive flash on the fired part which requires substantial clean up (de-flash) and represents a significant proportion of overall core cost.

Certain component designs may include a dual wall structure wherein two regions of metal are separated by a hollow space, as may commonly be used for internally cooled hot gas path components of a gas turbine engine. In cross-section, the component includes an outer tube wall encircling an inner rod (wall), thereby defining an open volume there between. The metal alloy component may be cast using a hollow ceramic core. The ceramic core defines the shape of the open volume when the component is cast within an outer casting shell.

Forming ceramic cores require first producing a consumable preform or internal mold geometry. A wax preform is then placed into a mold and ceramic slurry is injected around the preform. The ceramic slurry is dried to a green state and then removed from the mold and placed into a furnace for firing of the green body to form the ceramic core. Ceramic molds are often difficult to produce and subject to distortion, breakage and low yields because the green body strength of the dried but unfired ceramic slurry is low, and it remains unsupported on its interior surface once the wax preform melts.

As trailing edges become more advanced and fine feature based, this issue of removal of excessive flash is exacerbated further due to increasing number of smaller features. The current method of manufacturing involves the closing of two surfaces of silicone based mold material which defines the overall surface geometry of the core. Misalignment can occur with the two mold pieces that are weak. The cost of cleanup of a core can be as high as fifty percent of the cost of producing the core.

The core clean-up is generally manual for advanced features though in some cases CNC milling can be used for general core surface clean up. CNC milling is not generally successful for the cleanup of very fine features. FIG. 4 shows an example of a core with an advanced trailing edge. Another negative impact associated with the manual clean up of fine features is an inherent loss of good cores due to operator error.

SUMMARY

In an aspect of the present invention, a hard tool configuration for the manufacturing of advanced features in a ceramic core for a casting process, comprises: a first platform comprising a center facing side; a second platform comprising a center facing side, wherein the second platform is generally opposite from the first platform; a plurality of removable rake elements comprising a first end and a second end, wherein the first end is removably attached to the center facing side of the first platform and/or the second platform; and an internal mold geometry in a spacing in between the center facing side of the first platform and the center facing side of the second platform.

In another aspect of the present invention, a method of manufacturing advanced features in a ceramic core for a casting process comprises the steps of: providing a hard tool configuration comprising a first platform and a second platform, each having a center facing side; removably attaching a first end of a plurality of removable rake elements to the center facing side of the first platform and/or the second platform, wherein the plurality of removable rake elements comprise the first end and a second end; placing the center facing side of the first platform facing the center facing side 16 of the second platform with spacing in between; forming an internal mold geometry in the spacing in between the first platform and the second platform; moving the first platform and/or the second platform toward the internal mold geometry until the second end of the plurality of removable rake elements extend through and out of the internal mold geometry; pouring a slurry into the internal mold geometry; curing the slurry; raising the first platform and/or the second platform in a direction away from and out of the internal mold geometry; and removing the cured slurry in a green state.

BRIEF DESCRIPTION OF THE DRAWINGS

The invention is shown in more detail by help of figures. The figures show preferred configurations and do not limit the scope of the invention.

DETAILED DESCRIPTION

Figure 1:
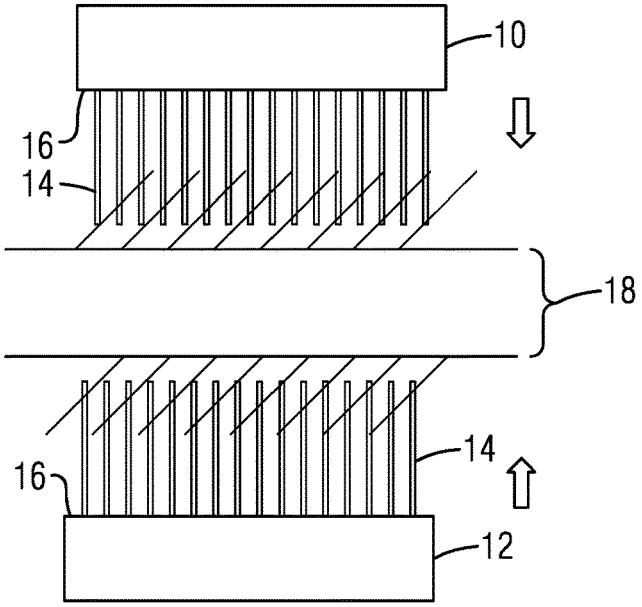
FIG. 1 is a side view of a tool arrangement of an exemplary embodiment of the present invention.

In the following detailed description of the preferred embodiment, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

Broadly, an embodiment of the present invention provides a hard tool configuration and method of manufacturing advanced detailed trailing edge features in a core for casting. The hard tool configuration includes at least a first platform and a second platform. The hard tool configuration also includes a first end of a plurality of removable rake elements removably attached to at least one of the first platform and the second platform. The hard tool configuration also includes an internal mold geometry in a spacing in between the center facing side of the first platform and the center facing side of the second platform.

As trailing edges on turbine blades become more advanced and fine feature based, the manufacturing of these airfoils and the costs involved become more important. Producing a blade can require first a production of a mold. In a more traditional mold, the mold form is slightly open where excessive mold filing and entrapped bubbles may exit. The part is eventually fired and a fired part produces an excessive amount of flash. Excessive flash on the fired part of the mold requires substantial clean up (de-flash) and represents a significant proportion of overall core cost. The excessive flash is exacerbated further due to increasing number of smaller features in more advanced trailing edges of blades.

A flash less trailing edge section requiring zero clean up, or close to zero clean up, post process is desirable. Embodiments of the present invention provide a method of manufacturing that may allow for the reduction of flash and clean up post process of a core. The turbine blade and airfoil are used below as an example of the method; however, the method may be used for any component requiring detailed features along a core for casting purposes. The turbine blade can be within the power generation industry.

The method and tooling assembly mentioned below may be in conjunction with a process that starts with a 3D computer model of a part to be created. From the model a solid surface is created from which a flexible mold can be created that is used in conjunction with a second mating flexible mold to form a mold cavity. The flexible mold is created from a machined master tool representing roughly fifty percent of the surface geometry of the core to be created. From such a tool, a flexible transfer mold can be created. In order to form a mold cavity, a second half of the master tool that creates a second flexible transfer mold, can be combined with the first flexible transfer mold to form the mold cavity. From such a mold cavity a curable slurry can be applied to create a three dimensional component form. An example of such a form can be a ceramic core used for investment casting.

The materials of construction of the core are specifically selected to work in cooperation with the casting and firing processes to provide a core that overcomes known problems with prior art cores. The materials and processes of the present invention result in a ceramic body which is suitable for use in a conventional metal alloy casting process.

Figure 2:
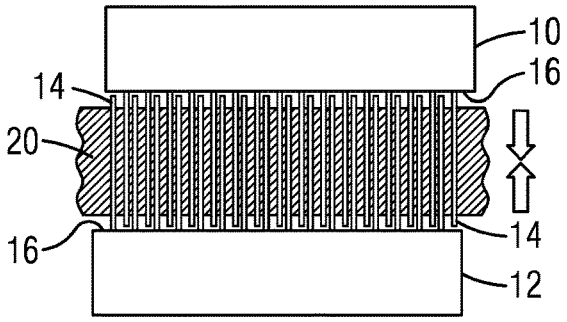
FIG. 2 is a side view of a tool arrangement after a slurry pour of an exemplary embodiment of the present invention.
Figure 3:
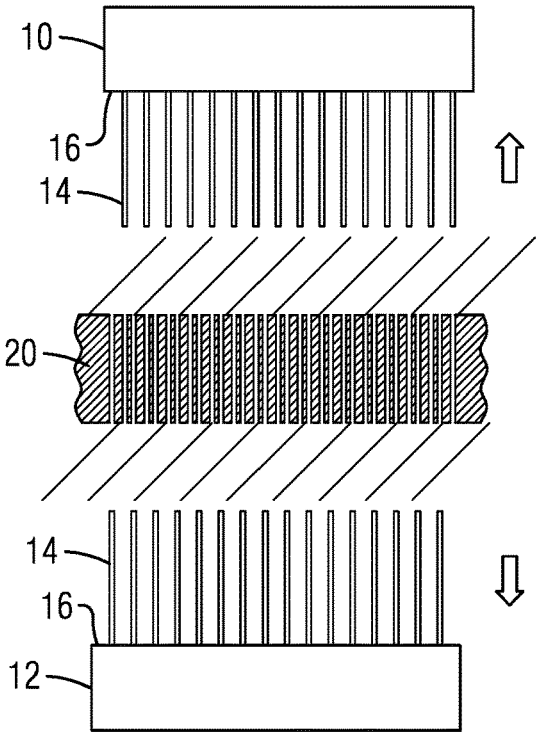
FIG. 3 is a side view of a withdrawal of a tool arrangement of an exemplary embodiment of the present invention.
Figure 4:
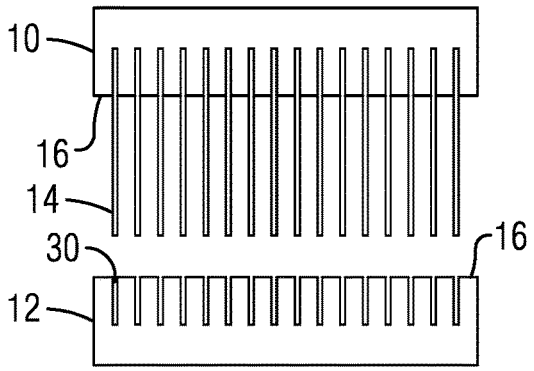
FIG. 4 is a side view of a tool arrangement of an exemplary embodiment of the present invention.
Figure 5:
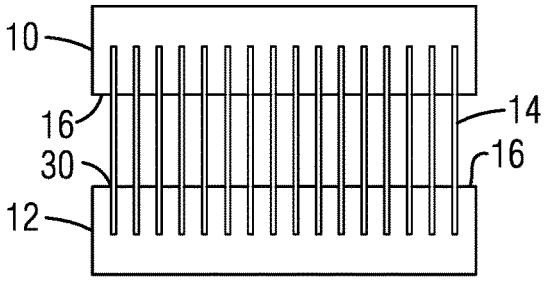
FIG. 5 is a side view of an engaged tool arrangement of an exemplary embodiment of the present invention.
Figure 6:
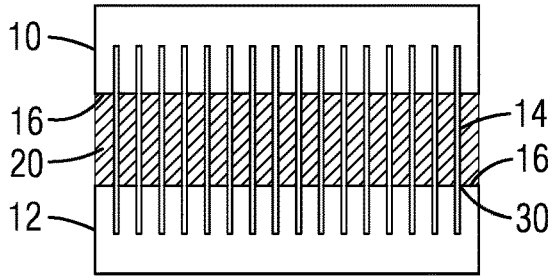
FIG. 6 is a side view of a tool arrangement after a slurry pour of an exemplary embodiment of the present invention.
Figure 7:
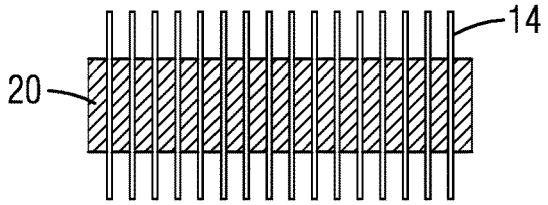
FIG. 7 is a side view of a tool arrangement after removal of molds of an exemplary embodiment of the present invention post cure.

As is illustrated in FIGS. 1 through 10, a method of manufacturing of advanced detailed trailing edge features in a core for casting may include a hard tool configuration. The casting may be investment casting or the like. The core may be a ceramic, as will be mentioned throughout, or other materials such as powdered metals, polymers, and composites. Molds may also be ceramic or of other materials. The hard tool configuration may include at least a first platform 10 and a second platform 12. The first platform 10 and the second platform 12 face each other while in the hard tool configuration. The first platform 10 and the second platform 12 each have a center facing side 16. The center facing side 16 of each of the first platform 10 and the second platform 12 face each other. In between the center facing side 16 of the first platform 10 and the second platform 12 is positioned an internal mold geometry 18 for a ceramic mold. The internal mold geometry 18 provides the basic shape for the core without the detailed features. The hard tool configuration may align along any axis, such as x, y, z with the first platform 10 positioned substantially opposite from the second platform 12 along an axis. FIGS. 1 through 3 show the first platform 10 and the second platform 12 along a vertical axis; however these positions are not limited to the vertical axis in various embodiments. The first platform 10 and the second platform 12 each provide a surface in between that the internal mold geometry 18 is to be formed.

Along the center facing side 16 of at least one of the first platform 10 and second platform 12 may be a plurality of removable rake elements 14. Each of the plurality of removable rake elements 14 may include a first end 22 that attaches to the center facing side 16. A second end 24 of each of the plurality of removable rake elements 14 may be along an opposite side from the first end 22 for engagement. The first end 22 of the plurality of removable rake elements 14 may removably attach to the center facing side 16 of at least one of the first platform 10 and second platform 12 of the hard tool configuration. The plurality of removable rake elements 14 may be made from a metal or the like. The quantity of the plurality of removable rake elements 14 is based on the predetermined detailed features to be applied to the core. Based on the design of the detailed features will determine the quantity, size, and shape of the plurality of removable rake elements 14.

Once the plurality of removable rake elements 14 are secure along at least one center facing side 16, the first platform 10, the second platform 12, or a combination of the first platform 10 and the second platform 12 may move in a direction towards the internal mold geometry 18.

A method of manufacturing advanced detailed trailing edge features includes providing the hard tool configuration as mentioned above. The hard tool configuration may include the first platform 10 and the second platform 12, each having a center facing side 16. The first end 22 of each of a plurality of removable rake elements 14 may be removably attached to the center facing side 16 of at least one of the first platform 10 and the second platform 12. The center facing side 16 of the first platform 10 and the second platform 12 are initially placed facing the internal mold geometry 18 that is formed. The mold may be of any geometry for the manufacturing of a ceramic core. To better view the method steps, parallel side walls that are a part of the internal mold geometry 18 have been removed from the figures.

Once the hard tool configuration has been set, the first platform 10 and/or the second platform 12 then are moved each towards the internal mold geometry 18 until the plurality of removable rake elements 14 have passed through and exited the internal mold geometry 18. A slurry 20 may then be poured through the internal mold geometry 18 filling around the plurality of removable rake elements 14 as is shown in FIG. 2. A curing process is started for a specific amount of time and completed to produce the cured slurry 20 in a green state. Once the curing process is completed, the first platform 10 and the second platform 12 are then extracted from the cured slurry 20 and internal mold geometry 18 as is shown in FIG. 3. The plurality of removable rake elements 14 define the shape of the portion of the internal mold geometry 18, such as within a trailing edge region 26. After the plurality of removable rake elements 14 are extracted from the cured slurry 20 after the cure, the mold is left with a flat surface and minimal to zero flash. The mold is placed in a furnace for firing of the green body to form a ceramic core.

Figure 8:
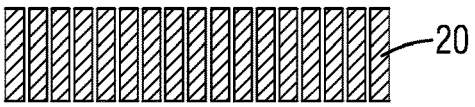
FIG. 8 is a side view of a withdrawal of a tool arrangement of an exemplary embodiment of the present invention.

Another embodiment may include the plurality of removable rake elements 14 removably attached to one of the first platform 10 and the second platform 12. The opposite platform, i.e. the first platform 10 or second platform 12 that does not have the plurality of removable rake elements 14 removably attached may include the center facing side 16 that includes a seal surface 30 that mirrors and engages the second end 24 of the plurality of removable rake elements 14. The method of manufacturing advanced detailed trailing edge features may include the first platform 10 and/or the second platform 12 then are moved each towards the internal mold geometry 18 until the plurality of removable rake elements 14 have passed through and exited the internal mold geometry 18 and have engaged with the seal surface 30 of center facing side 16 of the opposite platform. The first platform 10 and the second platform 12 surround the internal mold geometry with the plurality of removable rake elements 14 engaged with the seal surface 30. The internal mold geometry is filled with a slurry 20 and cured. Post curing, the first platform 10 and the second platform 12 may be removed from the cured slurry 20 leaving the plurality of removable rake elements 14 in place. The plurality of removable rake elements 14 may then be removed separately leaving a zero flash green body as is shown in FIG. 8.

Figure 9:
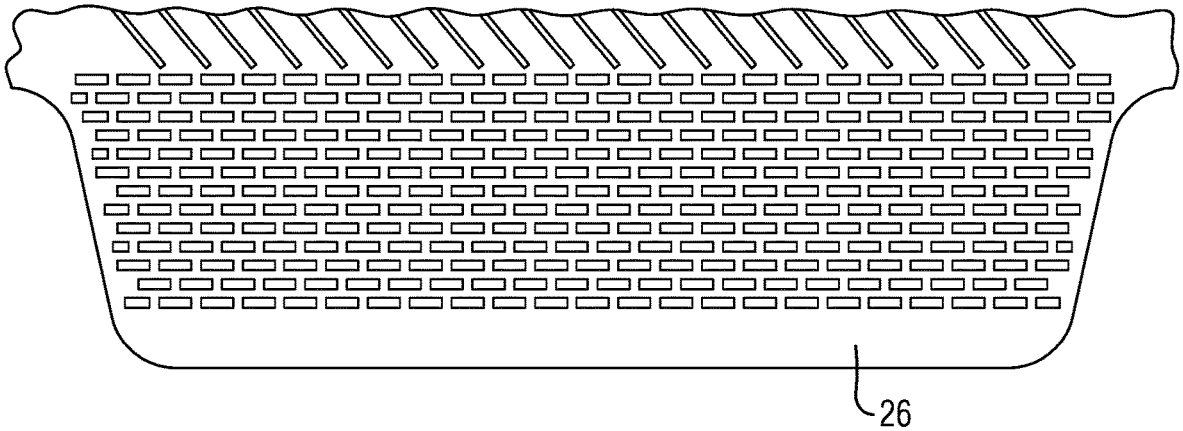
FIG. 9 is a front view of an embodiment of a trailing edge portion of a core for investment casing.

FIG. 9 shows an example of a core with an advanced detailed trailing edge 26 after a hard tool extraction. Small features align the trailing edge of the core. The shape of the small features is determined by the shape of the second end 24 of each of the plurality of removable rake elements 14.

Figure 10:
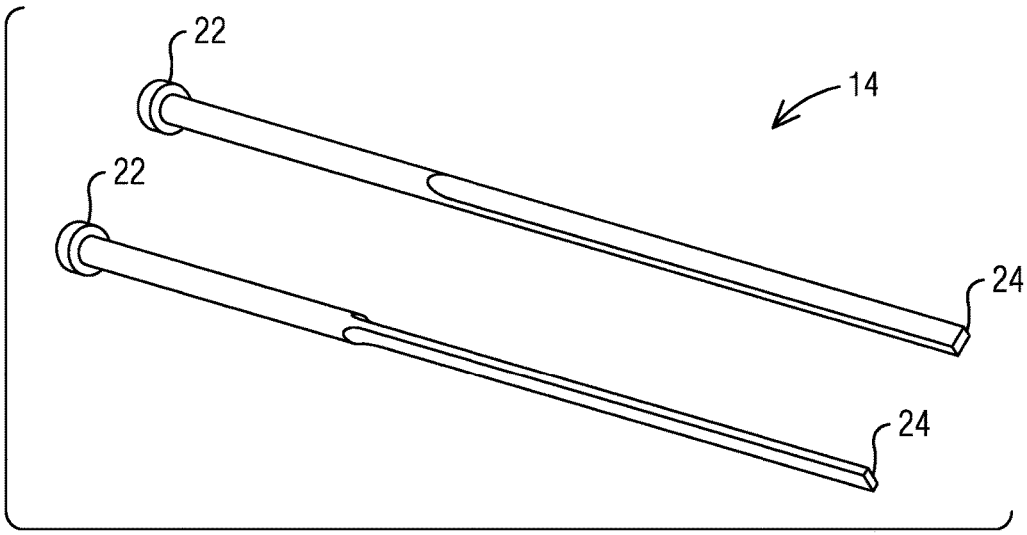
FIG. 10 is a perspective view of a plurality of removable rake elements of an exemplary embodiment of the present invention.

In certain embodiments of the hard tool configuration and method, the hard tool configuration may include plurality of removable rake elements 14, as is shown in FIG. 10, that can have a pin or similar connection point at a first end 22 with a matching engagement portion along the center facing side 16 of the first platform 10 and/or the second platform 12. The plurality of removable rake elements 14 also have the second end 24 that is for engagement with the internal mold geometry 18 and slurry 20. As mentioned above, the shape and size of the second end 24 of each of the plurality of removable rake elements 14 may determine the details of the small features of the eventual mold and ceramic core.

In certain embodiments, the plurality of removable rake elements 14 may be coated with a coating such as polytetrafluoroethylene (PTFE) or the like. The coating may allow for a clean, effective, linear extraction of the plurality of removable rake elements 14 after cure. The slurry 20 may form around the plurality of removable rake elements 14 without bonding to the plurality of removable rake elements 14 while drying allowing for a smooth release of the plurality of removable rake elements 14 from the mold. The coating may be controlled so that a maximum thickness is set. In certain embodiments, a range of substantially 50 microns or less may be used to maintain flow path geometry.

The plurality of removable rake elements 14 may be placed in an array. Depending on the number of removable rake elements 14 and the size of the rake array, the individual rake elements 14 may be either single sided or double sided.

Time to create a core can decrease significantly due to using an embodiment of this method of manufacturing. Costs can also decrease significantly with a reduction of flash due to the method being used. The release of the plurality of removable rake elements 14 from the cured slurry allows for a clean flat surface without flash.

An example of a process that can yield high resolution features or detail is tomo lithographic molding. Tomo lithographic molding can provide greater geometric and dimensional control with respect to high resolution features compared to conventional core formation processes. That capability can be combined with the present invention to produce metallic parts with advanced internal passageway geometries and tolerances from a clean, flash free mold.

Providing removable rake elements 14 within the manufacturing process to define the passageway geometries within the mold provide for a clean flash free area around the passageway geometries that allow for a faster and cheaper cleanup and preparation of the core. The issue of misalignment is removed with the engagement of the plurality of removable rake elements 14 instead of using multiple molds.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

What is claimed is:

1. A hard tool configuration for manufacturing of advanced features in a ceramic core for a casting process, comprising:

a first platform comprising a center facing side;

a second platform comprising a center facing side, wherein the second platform is opposite from the first platform;

a plurality of removable rake elements comprising a first end and a second end, wherein the first end is removably attached to the center facing side of the first platform and/or the second platform, wherein the removable rake elements include a pin as a connection point at the first end with a matching engagement portion along the center facing side of the corresponding platform the first end is removably attached to, wherein the pin has a circular end portion comprising an enlarged diameter, and wherein the shape and size of the second end of each of the removable rake elements determines the details of the features of the ceramic core; and an internal mold geometry in a spacing in between the center facing side of the first platform and the center facing side of the second platform.

2. The hard tool configuration of claim 1, further comprising a coating on a surface of the plurality of removable rake elements.

3. The hard tool configuration of claim 2, wherein an anti-release coating thickness is in a range of approximately 50 microns or less.

4. The hard tool configuration of claim 1, wherein the plurality of removable rake elements removably attach to one of the first platform and second platform and an opposite first platform or second platform comprises a seal surface for engaging the plurality of removable rake elements.

5. A method of manufacturing advanced features in a ceramic core for a casting process comprising the steps of:

providing a hard tool configuration comprising a first platform and a second platform, each having a center facing side;

removably attaching a first end of a plurality of removable rake elements to the center facing side of the first platform and/or the second platform, wherein the plurality of removable rake elements comprise the first end and a second end, wherein the removable rake elements include a pin as a connection point at the first end with a matching engagement portion along the center facing side of the corresponding platform the first end is removably attached to, wherein the pin has a circular end portion comprising an enlarged diameter, and wherein the shape and size of the second end of each of the removable rake elements determines the details of the features of the ceramic core;

placing the center facing side of the first platform facing the center facing side of the second platform with spacing in between;

forming an internal mold geometry in the spacing in between the first platform and the second platform;

moving the first platform and/or the second platform toward the internal mold geometry until the second end of the plurality of removable rake elements extend through and out of the internal mold geometry;

pouring a slurry into the internal mold geometry;

curing the slurry;

raising the first platform and/or the second platform in a direction away from and out of the internal mold geometry; and removing the cured slurry in a green state.

6. The method of claim 5, further comprising a coating on a surface of the plurality of removable rake elements.

7. The method of claim 6, wherein an anti-release coating thickness is in a range of approximately 50 microns or less.

8. The method of claim 5, wherein the ceramic core is designed for manufacturing of a turbine blade.

9. The method of claim 5, wherein the plurality of removable rake elements removably attach to one of the first platform and second platform and an opposite first platform or second platform comprises a seal surface, wherein the plurality of removable rake elements extend through and out of the internal mold geometry and removably engages with the seal surface.

10. The method of claim 9, wherein raising the first platform and/or the second platform in a direction away from and out of the internal mold geometry leaves in the plurality of removable rake elements within the cured slurry, wherein the plurality of removable rake elements are removed from the cured slurry prior to removing the cured slurry in a green state.

* * * * *